United States Patent [19]

Falcione

[11] 4,155,556

[45] May 22, 1979

[54] NUMBER GAME

[76] Inventor: Ronald D. Falcione, 17 Old Pottery La., Norwell, Mass. 02061

[21] Appl. No.: 785,064

[22] Filed: Apr. 6, 1977

[51] Int. Cl.[2] ..... A63F 3/00

[52] U.S. Cl. ..... 273/265; 273/239; 273/272

[58] Field of Search ..... 273/130 A, 130 AC, 130 E, 273/130 R, 135 R, 135 D, 136 B, 136 E, 137 AE, 272, 239, 265

[56] References Cited

U.S. PATENT DOCUMENTS

| | | | |
|---|---|---|---|
| 3,427,028 | 2/1969 | Abrahamsen | 273/135 D |
| 3,524,648 | 8/1970 | Nilan | 273/130 A UX |
| 3,649,023 | 3/1972 | Schohn | 273/271 |
| 3,844,568 | 10/1974 | Armstrong | 273/135 R |
| 3,948,526 | 4/1976 | Lukacik | 273/136 B |

*Primary Examiner*—Anton O. Oechsle
*Attorney, Agent, or Firm*—Kenway & Jenney

[57] ABSTRACT

A number game comprising a plurality of tiles and a tile support means having an intersecting pattern of one row and one column of tile receiving spaces is disclosed. The object of the game is to determine the mathematical number combinations chosen by the other players to fill their tile support means.

5 Claims, 4 Drawing Figures

NUMBER GAME

This invention relates to number games and in particular to a number game for two or more players in which the object is to guess the other opposing players' number combinations.

BACKGROUND OF THE INVENTION

Many of the word and number games presently available are complex or difficult to learn. Consequently, it is hard for players of different ages and experiences, for example, father and son, or mother and daughter, to equally enjoy the competition of the game due to the superior vocabulary and mathematical ability which is generally acquired with age. On the other hand, there are also available many simple games which unfortunately do not challenge the interest of both young and old.

It is therefore an object of the present invention to provide a number game which is easy to learn and play, which minimizes the experience and superior intellect generally acquired with age, and which provides strategies which can be understood and enjoyed by persons of all ages. Other objects of the invention are to provide a simple low cost number game which can be mass produced and which appeals to persons of all ages.

Yet a further object of the invention is to provide a game in which the rules can be easily varied to match the abilities of the players.

SUMMARY OF THE INVENTION

The invention features a number game having a plurality of indicia bearing tiles, a majority of the tiles bearing numerical characters and the remaining tiles bearing arithmetic operators. The invention further features a tile suport means having a plurality of tile receiving spaces for supporting the tiles in a readable manner whereby the supported numerical characters and arithmetic operators, if any, can be seen. The spaces are arranged in an intersecting pattern of one row and one column with two center spaces being positioned in the middle of and at the intersection of the row and column. Extending from the center spaces in each direction are four arms, one arm in each direction. Each arm has tile receiving spaces for a pair of two digit numbers, one pair at either end of each arm, and for an arithmetic operator between pairs of numbers.

According to the rules of the game each player first chooses a number-cross combination comprising a central two digit number and four arithmetic relationships between two pairs of two digit numbers, the solution of each arithmetic relationship equaling the central number. The four relationship and the central number would together fill the spaces of the tile support means. A first player then asks a selected opposing player whether his number-cross has a specific symbol, a numerical character or an arithmetic operator. If the particular selected player has that symbol in one or more heretofore unrevealed positions in his number-cross, he discloses one position (even if he has more than one still unrevealed in his number-cross) by placing a tile bearing that symbol in the corresponding space of his tile support means. If a player correctly guesses a symbol in an opposing player's number-cross, he takes another turn. If he guesses wrong, the next successive player takes his turn and play continues until the number-cross combination of one player only is not entirely revealed on his tile support means. Thus, the last person to have a support means in which there are unfilled spaces wins the game.

In a preferred variation of the game, a player cannot ask another player for an arithmetic operator until tiles have been placed on the central spaces of the player's tile support means. Then, in addition, the asking player preferably must also specify the arm of the tile support means in which the operator appears. If an arithmetic operator is incorrectly guessed, the asking player loses not only his present turn but his next turn as well.

DESCRIPTION OF THE DRAWINGS

Other objects, features and advantages of the invention will appear from the following description of a preferred embodiment taken together with the drawings in which.

DESCRIPTION OF A PREFERRED EMBODIMENT

Figure 1:
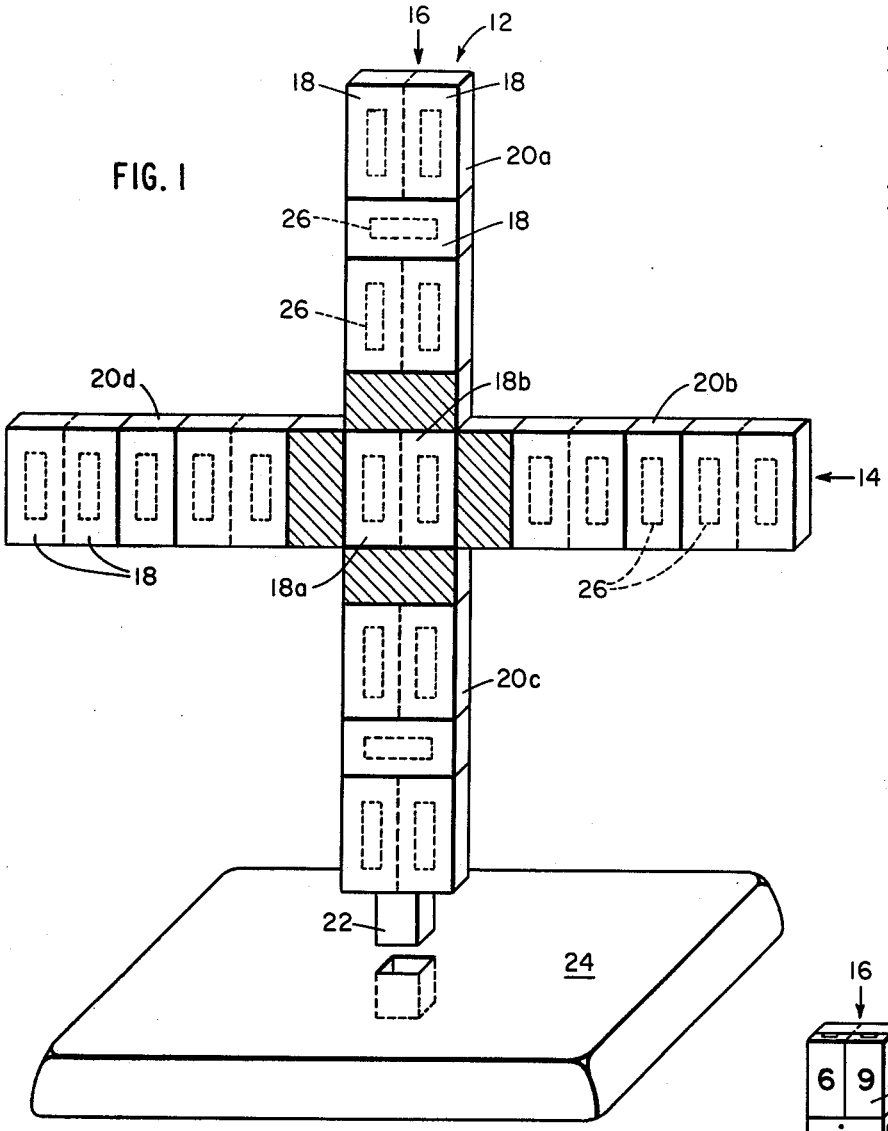
FIG. 1 is a perspective view of a preferred tile support means according to the invention.
Figure 2:
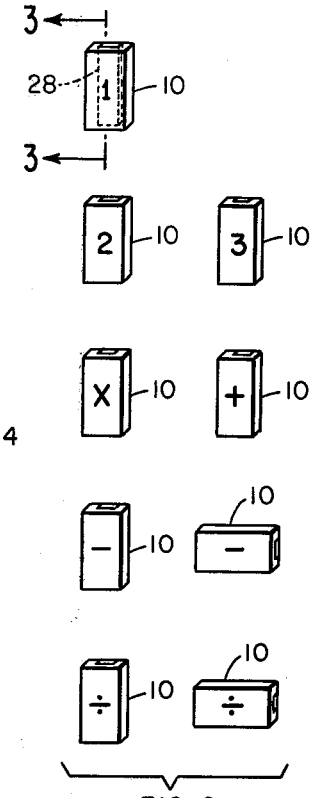
FIG. 2 is a perspective view of a plurality of tiles according to a preferred embodiment of the invention.
Figure 3:
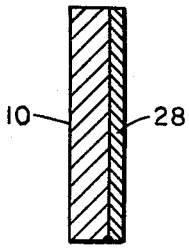
FIG. 3 is a cross-sectional view along 3—3 of FIG. 2.

Referring to FIGS. 1 and 2, the number game according to the invention comprises a plurality of tiles 10 bearing symbols, either numerical characters or arithmetic operators, for example addition, subtraction, division, or multiplication. The tiles are adapted to be received on or secured to a tile support means 12. The support means 12, in the preferred embodiment, is constructed in an intersecting relationship of a row structure 14 and a column structure 16. In the preferred embodiment, support means 12 has two central tile receiving spaces **18*a*, 18*b* and four mutually perpendicular arms 20*a*, 20*b*, 20*c*, 20*d*, each having a plurality of tile receiving spaces 18. The arms are connected to the center space in any way known in the art for example by adhesive cement, to form the tile support means 12. A support leg 22, connected to support arm 20*c*, is provided for supporting and orienting the tile support means vertically in a stationary base 24**.

Preferably, tile support means 12 is constructed to magnetically support tiles 10. Thus, behind each space 18 there is provided a magnet 26 to attract and hold tiles 10 which correspondingly are constructed of or at least include a magnetizable material for example, portions 28, which are thin strips of an iron containing material. Alternatively, a material such as Velcro or a mechanical arrangement could be used. The remainder of the tiles and the tile support means and base may be constructed of any suitable material, for example wood or plastic.

According to the preferred embodiment, each arm 20 is provided with five spaces 18 as shown in FIG. 1. The spaces are arranged to accommodate two pairs of two digit numbers connected by an arithmetic operator. The resulting indicated mathematical operations are read top to bottom for the column arms and left to right for the row arms.

The number game described in detail hereinafter is called "NUMBER-CROSS." The object of the number-cross game is to completely fill the spaces of each opponent's tile support means; i.e., to completely identify the numbers and arithmetic operators which each opponent has chosen to fill the spaces of the support means 12. Initially, each player selects a number-cross combination comprising the central two digit number and the four mathematical relationships. A number-cross code pad or other writing pad may be used to record the combination.

Figure 4:
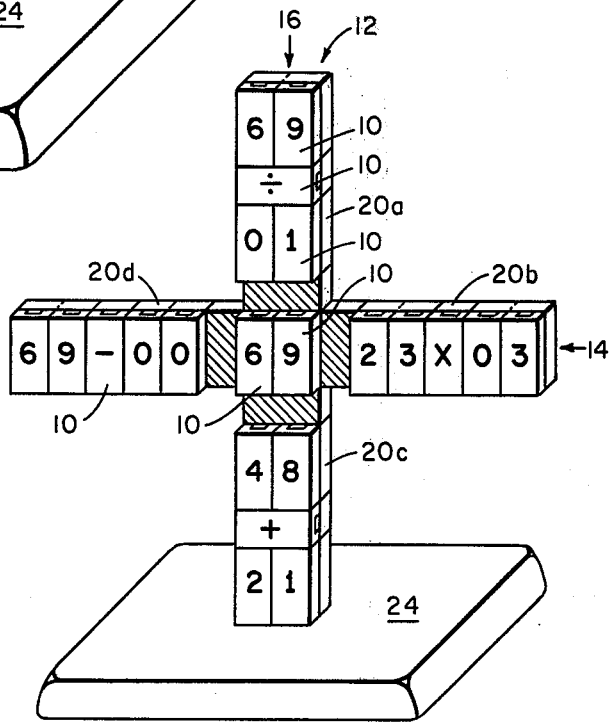
FIG. 4 is one possible number-cross combination according to the invention.

When a number-cross pad is used, and referring to the number-cross tile support means (FIG. 1 or FIG. 4), for reference, each player writes a two digit central number on his number-cross pad. This number will be the solution for the four mathematical relationships which will be placed on the four arms of the support means. The mathematical relationships are then filled in by placing an arithmetic operator (multiplication, division, subtraction, or addition) between pairs of two digit numbers. FIG. 4 shows a typical completed number-cross.

According to the rules of the game, the players, having selected their number-cross combinations (generally referred to as a number-cross), then take turns in order, and sequentially ask a selected opponent if he has a particular number or operator in his number-cross. If the selected opponent's number-cross includes the symbol in a heretofore unrevealed position, he proceeds to put a tile bearing that symbol into the space in his tile supporting means at a position in which the symbol appears. If his number-cross includes the symbol more than once, he discloses only one of the spaces having the symbol. When a player makes a correct guess, he is entitled to take another turn and continues to ask for symbols until he makes an incorrect guess. The play of the game continues in this fashion, requesting numbers or operators until the commplete number-cross of only one player is not fully disclosed. That player wins the game.

In a preferred variation of the rules described above, a player cannot request an operator from a selected opponent until that opponent has already revealed, in his tile support means, at least the central two digit number. If a player then requests an operator, he must also preferably specify the arm of the support means in which he thinks it is located. If the player is incorrect, he not only loses his present turn, but his next turn as well.

Other embodiments of the invention including variations of the rules or modifications of the structure of either the tile support means or the tiles will appear to those skilled in the art and are within the following claims.

What is claimed is:

1. A number game method associated with a plurality of tiles having symbols in the form of numerical characters and arithmetic operators displayed thereon, the majority of said tiles bearing numerical characters, and a tile support means having a plurality of tile receiving spaces for supporting the tiles in an intersecting pattern of one column and one row, whereby each tile can be supported so that its indicia bearing portion can be read, and two of said spaces being at an intersection of said row and column, the rules of the game method comprising the following steps:

each player selects a central two digit number, said number being the solution for four mathematical relationships, each player then selects the four mathematical relationships which can be placed one at each end of the row and column of the tile support means thereby forming a number-cross combination, the solution of each relationship being the central two digit number, a first player asks a selected opposing player whether his number-cross has a specific symbol, if a particular selected player has that symbol in one or more heretofore unrevealed positions of his number-cross, he discloses one position by placing a tile bearing that symbol in a corresponding space in his tile support means, if a player guesses correctly he guesses again, if a player guesses incorrectly, the next successive player takes his turn, and play continues until the tile support means of one player only is not entirely covered with tiles.

2. The number game method of claim 1 further comprising the step of supporting said tiles by magnetism.

3. The number game method of claim 1 further comprising the step of supporting said tile support means in a vertical orientation.

4. The number game method of claim 1 wherein the rules further include that an arithmetic operator cannot be requested of a selected player until at least tiles corresponding to the two central numbers have been placed on the selected player's support means, and if an operator is incorrectly requested, the requesting player loses his next turn.

5. The number game method of claim 4 wherein the rules of the game provide that the asking player must also specify the exact location of the operator.

* * * * *